US005163249A

United States Patent [19]

Kantanen

[11] Patent Number: 5,163,249

[45] Date of Patent: Nov. 17, 1992

[54] GUIDE FOR USE IN A GRINDING DEVICE

[76] Inventor: Sakari Kantanen, Hämeenkatu 45, SF-76150 Pieksämäki, Finland

[21] Appl. No.: 720,521

[22] PCT Filed: Dec. 27, 1989

[86] PCT No.: PCT/FI89/00238

§ 371 Date: Jun. 20, 1991

§ 102(e) Date: Jun. 20, 1991

[87] PCT Pub. No.: WO90/07401

PCT Pub. Date: Jul. 12, 1990

[30] Foreign Application Priority Data

Dec. 23, 1988 [FI] Finland ..... 885961

[51] Int. Cl.[5] ..... B24B 9/00; B24B 41/06

[52] U.S. Cl. ..... 51/135 R; 51/240 R; 51/240 A; 51/74 R; 51/102; 51/128; 51/137; 51/215 R

[58] Field of Search ..... 51/215 R, 215 AR, 241 G, 51/DIG. 15, 78, 102, 116, 128, 135 R, 137, 74 R, 76 R, 110, 240 R, 240 A, 138, 139, 165, 165.77; 144/286 R, 286 A, 287

[56] References Cited

U.S. PATENT DOCUMENTS 155,734 10/1874 Klaber ..... 51/240 A
2,725,691 12/1955 Sommer ..... 51/139
4,924,633 5/1990 Hock ..... 51/135 R

*Primary Examiner*—Bruce M. Kisliuk
*Assistant Examiner*—Jack Lavinder
*Attorney, Agent, or Firm*—Ostrolenk, Faber, Gerb & Soffen

[57] ABSTRACT

A guide for a grinding device, the grinding device being provided with a grinding tool having a width and a relative travelling direction crosswise to relative advancing movement with respect to the grinding tool of a workpiece to be ground by the grinding tool, the workpiece having a length to be worked that exceeds the width of the grinding tool, the grinding tool having a point of contact at an angle of contact with the workpiece, with the point of contact and angle of contact between the workpiece and grinding tool being adjustable. A setting portion is provided having a distance adjustable with respect to the grinding tool, the setting portion being adjustably rotatable about a first axis, the first axis being fixed relative to the grinding tool. The setting portion is provided with an adjusting device disposed adjacent the grinding tool, the adjusting device having a body portion, at least one support being provided on the body portion for biasing against an edge of the workpiece. The body portion is journalled about a second axis fixed with respect to the setting portion so that the body portion is adjustably rotatable relative to the setting portion.

15 Claims, 1 Drawing Sheet

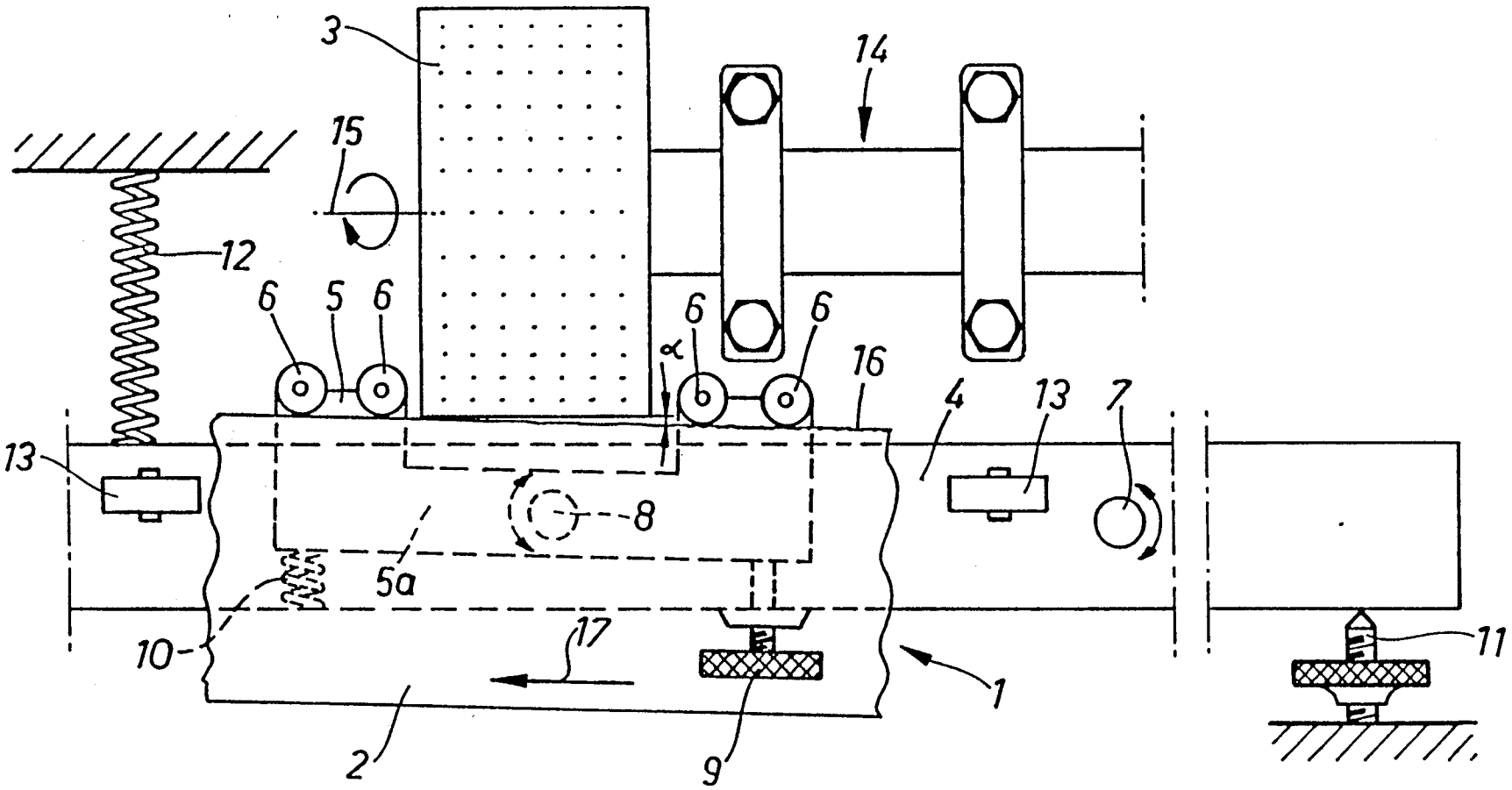
11
7
13
4
1
14
16
6
6
α
9
8
17
3
15
5
6
5a
2
6
12
10
13

GUIDE FOR USE IN A GRINDING DEVICE

BACKGROUND OF THE INVENTION

The present invention relates to a guide for use in a grinding device, particularly for an abrasive belt grinder, the grinding tool of the grinding device having a traveling direction which is crosswise to the advancing movement, for advancing a piece to be worked, whose length to be worked exceeds the width of a grinding tool, relative to a grinding tool, or alternatively, for advancing a grinding tool relative to a piece to be worked in a manner that the point of contact and the angle of contact between a piece to be worked and a grinding tool are adjustable.

For example, when grinding the edges of plate-like pieces as described above, a problem is the strength of the abrasive belt since a piece to be worked can easily strike against the belt edge and the belt. Particularly, when working the edges of, e.g., glass or stone plates, which usually involves the use of valuable diamond-coated abrasive belts, such premature destruction of a belt incurs substantial economic costs.

SUMMARY OF THE INVENTION

In order to eliminate these drawbacks, an object of the invention is to provide a guide for adjusting the contact point and contact angle between a piece to be worked and a grinding tool such that it is virtually impossible for a piece to be worked to strike against the edge of an abrasive belt to break or, alternatively, to collide with the side edge of an abrasive disc. Another object of the invention is to provide a guide for precisely controlling the amount of material to be removed.

These objects are solved according to the invention by providing a guide which comprises a setting portion adjustable in its distance relative to a grinding tool, the setting portion being provided with an adjusting means which is fitted on either side of the grinding tool with at least one support braced against the edge to be worked in a piece to be worked and or against a separate steering element, which support is adjustable relative to the setting portion.

The adjusting means for controlling the contact angle between a workpiece and a grinding tool is, in one preferred embodiment of the invention, arranged in a manner that the adjusting means comprises a body portion journalled to be rotatably adjustable relative to an axle which is fixed relative to the setting portion, the supports being mounted on that body portion. Thus, the adjustment of the adjusting means is effected by means of a setting screw and a spring.

The setting portion for regulating the quantity of material to be removed is in one preferred embodiment of the invention arranged such that the setting portion is made adjustably rotatable relative to an axle which is fixed relative to the grinding device. Thus, the adjustment of the setting portion is effected by means of a setting screw and a spring.

The supports mounted on the adjusting means and braced against the edge to be worked in a piece to be worked and/or against a separate steering element are positioned on a common straight line. The support can be a sliding surface, a rotatably journalled roller or the like. The support may have a sliding surface, a roller or the like that can be made removable, whereby the necessary bracing can be readily varied according to dimensions and configurations of the piece to be worked.

BRIEF DESCRIPTION OF THE DRAWINGS

The invention will now be described in more detail with reference made to the accompanying drawing, the sole FIGURE thereof showing in a diagrammatic plan view the operation of a guide of the invention in a case where a piece to be worked is advanced relative to a stationary grinding device.

DETAILED DESCRIPTION

Referring to the accompanying FIGURE, reference numeral 14 generally designates a grinding device provided with a shaft 15 for driving a grinding tool 3 indicated by reference numeral 3. The grinding tool 3 can be e.g. an abrasive belt fitted on top of an elastic drum or a belt rotating on two reversing wheels. The grinding tool can also be a fixed abrasive cylinder or a disc having only its cylindrical surface provided with abrasive components.

A guide used in the grinding device is generally indicated by reference numeral 1. Guide 1 is provided with a setting portion 4 which is adjustable in its distance relative to grinding tool 3 and which, in the enclosed FIGURE, comprises a rectangular profiled pipe. The setting portion 4 is provided with an adjusting means 5 which in the traveling direction of a piece 2 to be worked on either side of grinding tool 3 is fitted with at least one support 6, braced against a machinable edge 16 in the piece to be worked and being adjustable relative to setting portion 4.

In the illustrated embodiment, the setting portion 4 is arranged to be adjustably rotatable relative to an axle 7 which is fixed relative to grinding device 14. The adjustment is effected by turning a setting screw 11. On the other side, a spring 12 insures that the setting portion 4 is continuously pressed against setting screw 11.

The adjusting means 5 is journalled relative to setting portion 4 through the intermediary of an axle 8 which is fixedly fitted in setting portion 4 parallel to axle 7. In order to rotate adjusting means 5 relative to axle 8, the setting portion 4 is provided with a setting screw 9 as well as a spring 10 for ensuring that adjusting means 5 is always pressed against setting screw 9.

The plate-lik adjusting means 5 has a body portion 5*a* fitted inside a profiled pipe of setting portion 4 such that the supports 6 mounted on body portion 5*a* and extending perpendicularly therefrom are disposed on both sides of grinding tool 3. The FIGURE illustrates four supports 6. The supports 6 are arranged on a common straight line and dimensioned to extend against the edge of a piece 2 to be worked. The support 6 can comprise a sliding surface, a rotatably journalled roller, as shown in the FIGURE, or the like. The setting portion 4 is provided with a number of conveyor rollers 13 for facilitating the advance of workpiece 2. The rollers can be arranged in one or a plurality of rows, also outside the setting portion 4. Rollers 13 can be driving or idling.

When operating guide 1, the grinding of a piece to be worked is effected as follows:

A piece to be worked is laid upon rollers 13 on top of setting portion 4 as well as upon rollers, not shown, external of setting portion 4. An edge 16 to be worked in workpiece 2 is placed against support rollers 6 on the right-hand side of grinding tool 3 in the FIGURE.

This is followed by advancing piece 2 in the direction of arrow 17 relative to grinding tool 3 while maintaining the piece 2 continuously pressed against support rollers 6, whereby it is also tangential with support rollers 6 on the left-hand side of grinding tool 3.

An angle $\alpha$ between the machined edge of workpiece 2 and the working surface of grinding tool 3 is set by adjusting setting screw 9 of adjusting means 5 a such that the distance between workpiece and grinding tool 3 is longer on the right-side than on the left-hand side of the FIGURE. Thus, the piece 2 always finds the abrasive surface of grinding tool 3 instead of the edge of a grinding tool, the latter resulting in the destruction of a grinding tool.

This is followed by determining the amount of removed material by turning the setting screw 11 of setting portion 4.

By the proper adjustment of both setting screws 9, 11 the entire abrasive surface of grinding tool 3 can be effectively utilized without a hazard of piece 2 striking against the edge of grinding tool 3.

The invention is described above with reference made only to one of its preferred embodiments, wherein a piece 2 to be worked is advanced relative to a stationary grinding tool 3. It should be appreciated, however, that a guide of the invention can also be operated by advancing a grinding tool relative to a stationary workpiece. Hence, if desired, it is also possible to use a separate steering element, in which case the supports of an adjusting means are pressed against this steering element for the duration of working. Thus, the edges of a piece to be worked secured parallel to a steering element can be made straight (or to conform to the shape of a steering element) regardless of the standard of a preliminary working effected on a piece to be worked. It is also obvious of course that a guide of the invention can be used in grinding devices, in which the grinding is effected by the frontal surface of a disc.

I claim:

1. A guide for a grinding device, said grinding device being provided with a grinding tool having a width and a relative travelling direction crosswise to a relative advancing movement, with respect to the grinding tool, of a workpiece to be ground by the grinding tool, the workpiece having a length to be worked that exceeds the width of the grinding tool, the grinding tool having a point of contact at an angle of contact with the workpiece, the point of contact and angle of contact between the workpiece and grinding tool being adjustable, said guide includes a setting portion for supporting the workpiece, having a first position adjustable with respect to the grinding tool, said setting portion being adjustably rotatable about a first axis, the first axis being fixed relative to the grinding tool, said setting portion being provided with an adjusting means disposed adjacent the grinding tool, the adjusting means having a body portion, at least one support being provided on the body portion for biasing against an edge of the workpiece, said body portion being journalled about a second axis fixed with respect to the setting portion so that said body portion is adjustably rotatable relative to the setting portion in order to vary the angle of contact.

2. A guide as set forth in claim 1, wherein a plurality of said supports are provided on said adjusting means body portion disposed on a common straight line.

3. A guide as set forth in claim 1, wherein said support comprises a sliding surface or a rotatably journalled roller.

4. A guide as set forth in claim 3, wherein the sliding surface or roller is removable.

5. A guide as set forth in claim 1, further comprising an adjusting member for adjusting said adjusting means comprising a setting screw and a spring coupled to said adjusting means.

6. A guide as set forth in claim 1 further comprising a further adjusting member for adjusting the setting portion comprising a setting screw and a spring coupled to the setting portion.

7. A guide as set forth in claim 1, wherein the setting portion is provided with at least one conveyor roller.

8. A guide as set forth in claim 7, wherein said conveyor roller comprises a driven roller or an idling roller.

9. A guide for a grinding device, said grinding device being provided with a grinding tool having a width and a relative travelling direction crosswise to a relative advancing movement, with respect to the grinding tool, of a workpiece to be ground by the grinding tool, the workpiece having a length to be worked that exceeds the width of the grinding tool, the grinding tool having a point of contact at an angle of contact with the workpiece, the point of contact and angle of contact between the workpiece and grinding tool being adjustable said guide includes a setting portion for supporting a workpiece first having a first portion adjustable with respect to the grinding tool, said setting portion being adjustably rotatable about a first axis, the first axis being fixed relative to the grinding tool, said setting portion being provided with an adjusting means disposed adjacent the grinding tool, the adjusting means having a body portion, at least one support being provided on the body portion for biasing against an edge of the workpiece, said body portion being journalled about a second axis fixed with respect to the setting portion so that said body portion is adjustably rotatable relative to the setting portion, in order to vary the anode of contact said setting portion being provided with at least one conveyor roller for biasing against the workpiece.

10. A guide as set forth in claim 9, wherein a plurality of said supports are provided on said adjusting means body portion disposed on a common straight line.

11. A guide as set forth in claim 9, wherein said support comprises a sliding surface or a rotatably journalled roller.

12. A guide as set forth in claim 11, wherein the sliding surface or roller is removable.

13. A guide as set forth in claim 9, further comprising an adjusting member for adjusting said adjusting means comprising a setting screw and a spring coupled to the adjusting means.

14. A guide as set forth in claim 9, further comprising an adjusting member for adjusting the setting portion comprising a setting screw and a spring coupled to the setting portion.

15. A guide as set forth in claim 9, wherein said conveyor roller comprises a driven roller or an idling roller.

* * * * *